US006510843B2

(12) United States Patent
De Matthaeis

(10) Patent No.: US 6,510,843 B2
(45) Date of Patent: Jan. 28, 2003

(54) VALVE SYSTEM FOR CONTROLLING THE FUEL INTAKE PRESSURE IN A HIGH-PRESSURE PUMP

(75) Inventor: Sisto Luigi De Matthaeis, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/908,716

(22) Filed: Jul. 19, 2001

(65) Prior Publication Data

US 2002/0034448 A1 Mar. 21, 2002

Related U.S. Application Data

(63) Continuation of application No. PCT/IT00/00487, filed on Nov. 29, 2000.

(30) Foreign Application Priority Data

Nov. 30, 1999 (IT) ..... TO99A1054

(51) Int. Cl.[7] ..... F02M 37/04
(52) U.S. Cl. ..... 123/506; 123/446
(58) Field of Search ..... 123/446, 495, 123/457, 506; 417/273, 286

(56) References Cited

U.S. PATENT DOCUMENTS 4,719,889 A * 1/1988 Amann et al. ..... 123/447
4,884,545 A * 12/1989 Mathis ..... 123/446
5,884,606 A * 3/1999 Kellner et al. ..... 123/446
5,927,322 A * 7/1999 Rosenau ..... 123/446
5,971,718 A * 10/1999 Krueger et al. ..... 417/286
6,253,734 B1 * 7/2001 Rembold et al. ..... 123/446
6,311,674 B1 * 11/2001 Igashira et al. ..... 123/458
6,345,608 B1 * 2/2002 Rembold ..... 123/506

FOREIGN PATENT DOCUMENTS

| | | | |
|---|---|---|---|
| DE | 196 12 413 | 3/1996 | |
| DE | 196 30 938 | 7/1996 | |
| DE | 196 53 339 | 12/1996 | |
| DE | 197 14 489 | 4/1997 | |
| DE | 198 34 121 | * 7/1998 | ..... F02M/37/00 |

* cited by examiner

*Primary Examiner*—Thomas N. Moulis
(74) *Attorney, Agent, or Firm*—Merchant & Gould P.C.

(57) ABSTRACT

The capacity of a high-pressure pump (6) is regulated by a valve system including a variable-capacity on-off valve (23) and an overpressure valve (31). The overpressure valve has a valve body (33) having a cylindrical wall (35) forming a cavity (34) in which slides a shutter (37) having a lateral wall (51) and an end wall (52). The shutter (37) is pushed into a closed position by a calibrated spring (58). The cylindrical wall (35) has first holes (44) for allowing the passage of enough fuel to lubricate the inside of the pump (6), and second holes (47) for supplying the pump (6) via a supply conduit (68) and for draining any surplus fuel into a recirculating conduit (32). The first holes (44) and the second holes (47) are opened by different displacements of the lateral wall (51) of the shutter (37); and the end wall (52) has a calibrated air vent hole (64).

21 Claims, 2 Drawing Sheets

FIG. 2
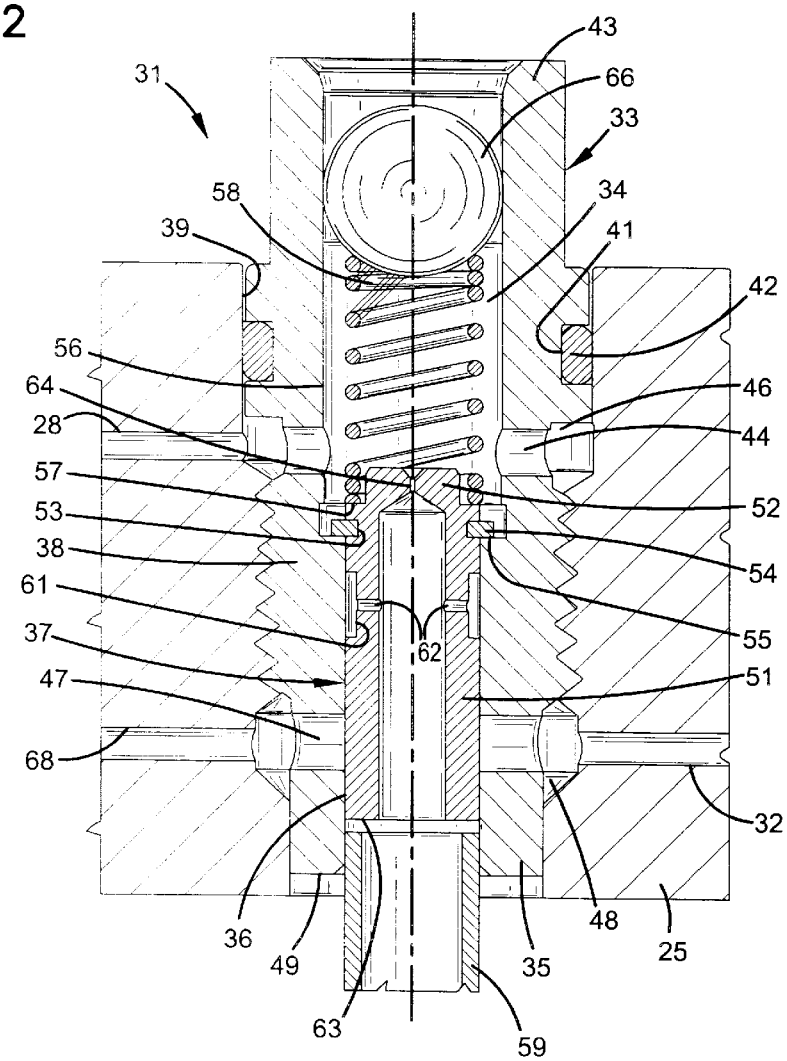
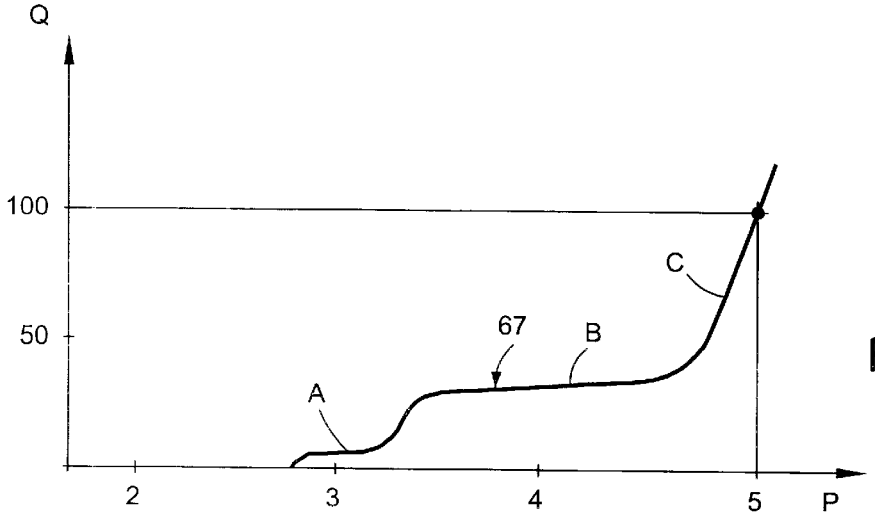
FIG. 3

VALVE SYSTEM FOR CONTROLLING THE FUEL INTAKE PRESSURE IN A HIGH-PRESSURE PUMP

This application is a continuation of PCT/IT00/00487 filed Nov. 29, 2000.

TECHNICAL FIELD

The present invention relates to a valve system for controlling the intake pressure of a fluid in a high-pressure pump—e.g. a fuel for supply to an injection engine—and to a relative overpressure valve.

BACKGROUND ART

As is known, when a variable quantity of high-pressure fluid is required, the maximum quantity of fluid is normally compressed, and the delivery pressure of the pump is controlled by a first overpressure valve which drains off the surplus high-pressure fluid. The intake pressure of the fluid is in turn controlled by a second overpressure valve which drains off the surplus low-pressure fluid.

In the case of fuel supply to an injection engine, the high-pressure fuel is supplied by a high-pressure, normally piston, pump in turn supplied from the fuel tank by a low-pressure pump.

Known supply devices require two separate pressure control valves: one for controlling the high pressure of the fuel downstream from the high-pressure pump, and the other for controlling the pressure of the fuel entering the pump. Valve systems of this sort are therefore complicated and expensive.

Moreover, energy is obviously wasted by the overpressure valve downstream from the high-pressure pump recirculating back into the tank the surplus fuel pumped by the high-pressure pump. And since compression generates heat, this enters the fuel in the tank, thus resulting in an increase in the temperature of the fuel to be pumped. This in turn increases fuel leakage of the pump pistons, thus reducing the efficiency of the pump, so that a cooler may also be required.

DISCLOSURE OF INVENTION

It is an object of the present invention to provide a valve system for controlling the fluid intake pressure of a pump, and which provides for maximum efficiency, is low-cost, and eliminates the aforementioned drawbacks typically associated with known valve systems.

According to the present invention, there is provided a valve system for controlling the intake pressure of a fluid in a high-pressure pump, comprising an on-off valve for the fluid entering said pump; characterized in that the intake pressure of said pump is controlled by an overpressure valve communicating with said on-off valve and for draining any surplus fluid for supply to said pump.

More specifically, the fluid is a fuel for supply to an injection engine, the on-off valve is a variable-capacity electromagnetic valve, and the overpressure valve communicates with the delivery side of a low-pressure pump.

Preferably, the overpressure valve comprises a valve body having a cylindrical cavity, in which slides a cylindrical shutter comprising a lateral wall and an end wall; a calibrated spring being located outside the shutter, between the end wall and a member fitted inside said cavity.

BRIEF DESCRIPTION OF THE DRAWINGS

A preferred, non-limiting embodiment of the invention will be described by way of example with reference to the accompanying drawings, in which:

FIG. 2 shows a mid-section of an overpressure valve for controlling the intake pressure of the FIG. 1 device;

FIG. 3 shows a graph of the characteristic of the FIG. 2 overpressure valve.

BEST MODE FOR CARRYING OUT THE INVENTION

Figure 1:
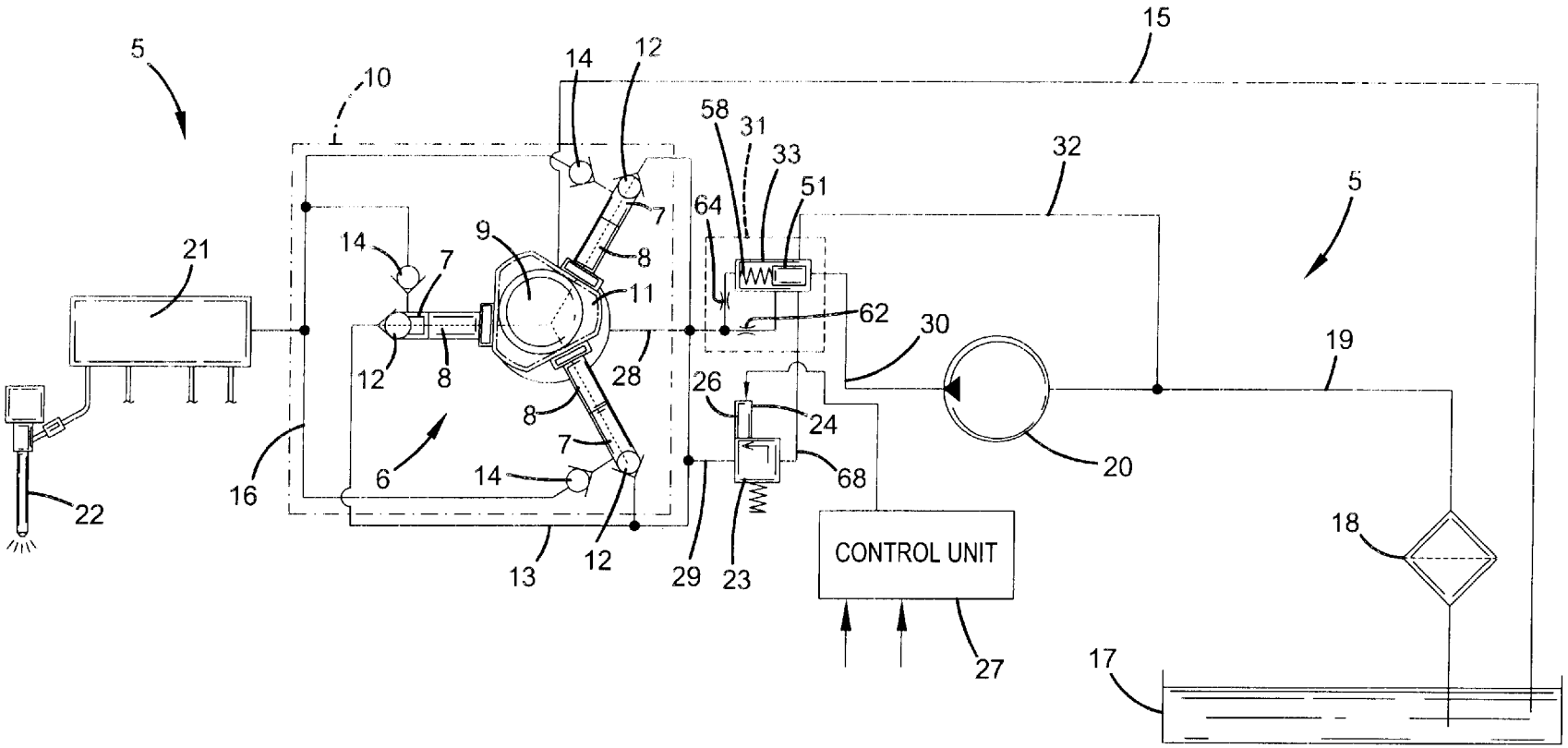
FIG. 1 shows a diagram of an injection engine fuel supply device comprising a valve system in accordance with the invention.

Number 5 in FIG. 1 indicates as a whole a device for supplying fuel to an injection engine, e.g. a vehicle multi-cylinder diesel engine. Device 5 comprises a high-pressure pump 6, e.g. a known type with three radial cylinders 7, in which operate three corresponding pistons 8 operated by an actuating mechanism comprising a common cam 9 and a faced ring 11.

Each cylinder 7 has an intake valve 12 communicating with a low-pressure intake conduit 13; and a delivery valve 14 communicating with a high-pressure delivery conduit 16. Cylinders 7 and actuating mechanism 9, 11 are housed in a hollow body indicated schematically by 10 in FIG. 1 and which carries delivery conduit 16 substantially as described in the Applicant's European Patent N. 851.120.

Body 10 is closed by a flange 25 shown partly in FIG. 2 and which carries intake conduit 13 (FIG. 1). Conduit 13 receives fuel from a normal fuel tank 17 via a filter 18 and along an input conduit 19 of a low-pressure pump 20, which may be electric, activated by an electric motor, or mechanical, e.g. a gear pump activated by the shaft of the injection engine itself. Cam 9 and ring 11 of pump 6 are lubricated by part of the incoming fuel from conduit 13, which is fed back into tank 17 along a recirculating conduit 15.

Delivery conduit 16 of high-pressure pump 6 communicates with a vessel 21 known as a "common rail" and which communicates with a series of electromagnetic injectors 22, each of which is controlled to inject, into the injection engine at each cycle, a quantity of fuel metered according to the instantaneous power required of the engine.

According to the invention, the valve system for controlling the intake pressure of the fuel comprises an on-off valve 23 and an overpressure valve 31. The on-off valve is a variable-capacity electromagnetic valve 23, controls the quantity of fuel entering high-pressure pump 6, communicates with intake conduit 13 of pump 6 along an output conduit 29, and is controlled by an armature 24 of a solenoid 26, which is controlled by an electronic control unit 27 as a function of signals indicating various parameters of the instantaneous power requested of the injection engine.

Electromagnetic valve 23 also communicates with an input conduit 68 connected to overpressure valve 31, which also communicates with a recirculating conduit 32 which comes out inside input conduit 19 of low-pressure pump 20. The input of valve 31 communicates via a conduit 30 with the delivery side of low-pressure pump 20; and electromagnetic valve 23 and overpressure valve 31 are housed in respective seats in flange 25 of pump 6.

More specifically, overpressure valve 31 comprises a valve body 33 (FIG. 2) and a substantially cylindrical wall 35 having a cavity 34; cavity 34 comprises a first cylindrical portion 36 in which slides a cylindrical shutter 37; and wall 35 of valve body 33 comprises a threaded portion 38 which engages a threaded portion of a hole 39 in flange 25.

Wall 35 also has an annular groove 41 housing a seal 42 in another portion of hole 39. A portion 43 of valve body 33, on the opposite side of groove 41 to threaded portion 38, is externally prismatic to permit assembly to flange 25 by means of an appropriate tool.

Valve body 33 has at least a first orifice for lubricating the inside of pump 6. More specifically, valve body 33 has four angularly equally spaced radial holes 44 formed in cylindrical wall 35 at an annular chamber 46 in flange 25. Chamber 46 is located between threaded portion 38 and groove 41, and communicates via an input conduit 28 with hollow body 10 of pump 6.

Valve body 33 also has at least a second orifice for supplying pump 6 via conduit 68 and electromagnetic valve 23 (see also FIG. 1), and for draining or recirculating surplus fuel via conduit 32. More specifically, valve body 33 has another four radial holes 47 formed in wall 35 and slightly larger in diameter than holes 44. Holes 47 are also equally spaced angularly at an annular chamber 48 located between threaded portion 38 and an end edge 49 of wall 35, and are therefore located in a different axial position from that of holes 44.

Cylindrical shutter 37 comprises a lateral wall 51; an end wall 52; an annular groove 53 housing a C-ring 54, e.g. a retaining ring, for engaging a shoulder 55 separating portion 36 of cavity 34 from a larger-diameter second portion 56; and a shoulder 57 for engaging a first end of a compression spring 58 calibrated and precompressed as described later on.

Spring 58 normally keeps shutter 37 in a position closing valve 31, with ring 54 resting elastically on shoulder 55 of cavity 34. Valve body 33 is connected by a fitting 59 to conduit 30 on the delivery side of low-pressure pump 20; and shutter 37 is moved into a position opening valve 31 by the thrust exerted by the incoming fuel from fitting 59.

Shutter 37 comprises first means for internally lubricating pump 6, and in turn comprising an annular chamber 61 formed in lateral wall 51 of shutter 37, and a series of three or four calibrated, angularly equally spaced radial holes 62 of 0.3 to 0.4 mm in diameter. Annular chamber 61 is normally located at portion 36 of cavity 34 and therefore does not communicate with holes 44 in valve body 33, and is connected to holes 44 by a predetermined displacement of shutter 37 in opposition to spring 58.

Shutter 37 also comprises second means for supplying electromagnetic valve 23, and hence pump 6, and for draining into recirculating conduit 32 any fuel in excess of the capacity of electromagnetic valve 23. The second means comprise an end edge 63 of lateral wall 51 of shutter 37, which is normally located below holes 47 in valve body 33, and which is moved into a position above holes 47 when the intake pressure of the fuel exceeds the predetermined 5-bar pressure, thus displacing shutter 37 by more than said predetermined displacement.

Finally, shutter 37 comprises third means defined by a calibrated hole 64 in end wall 52 of shutter 37. Calibrated hole 64 has a diameter of 0.1 to 0.3 mm and provides for venting valve 31 before holes 47 and 62 are opened. Hole 64 also allows a certain amount of fuel through holes 44, even when valve 31 is closed, to expel any air from valve 31 and prelubricate the various mechanical connection of pump 6.

The outer end (at the top in FIG. 2) of spring 58 rests against a fixed member 66, which can be fixed variably along portion 56 of cavity 34 to calibrate spring 58. More specifically, member 66 may be defined by a ball force-fitted inside portion 56 of cavity 34, or by a threaded pin (not shown) screwed to a corresponding thread of portion 56 of cavity 34.

To calibrate and precompress spring 58, overpressure valve 31 is supplied via fitting 59 connected to a gauge; the fuel flow rate from a conduit equivalent to conduit 32 is measured; and member 66 is moved axially, until shutter 37 is positioned to give a flow rate of 100 l/h and 5-bar pressure.

The valve system described operates as follows.

When the injection engine is off, pumps 6 and 20 (see also FIG. 1) are off so that spring 58 keeps shutter 37 in the closed position closing overpressure valve 31 as shown in FIG. 2. When the injection engine is turned on, pumps 20 and 6 are also turned on; and low-pressure pump 20 draws fuel from tank 17 through filter 18 and along input conduit 19, and feeds it to input conduit 30 of overpressure valve 31.

As long as the delivery pressure of low-pressure pump 20 is below 5 bars, the incoming fuel from fitting 59 fails to overcome spring 58, so that valve 31 remains closed. The fuel, however, first expels any air from valve 31 through calibrated hole 64 in end wall 52, through holes 44 in valve body 33, and along conduit 28. Then, when the fuel pressure exceeds 3 bars, shutter 37 begins moving in opposition to spring 58.

FIG. 3 shows a curve 67 of fuel flow Q along conduits 28, 32 and 68 as a function of intake pressure P measured experimentally. During venting, fuel flow Q is determined solely by calibrated hole 64 and is indicated by a first portion A of curve 67.

As the intake pressure of the fuel in overpressure valve 31 rises, shutter 37 continues moving in opposition to spring 58. As one of the edges of chamber 61 (the top edge in FIG. 2) passes shoulder 55, the fuel flowing through calibrated holes 62 first fills annular chamber 61 and then flows through holes 44 and annular chamber 46 into conduit 28 to lubricate the mechanical connections of high-pressure pump 6. For fuel pressures ranging from about 3.3 to 4.7 bars, flow Q is brought to about 25% of the required value as shown by portion B of curve 67.

Finally, as the intake pressure of the fuel exceeds 4.7 bars, the end edge 63 of shutter 37 exposes holes 47; the fuel supplies electromagnetic valve 23 via annular chamber 48 and conduit 68; the surplus fuel is drained into recirculating conduit 32; and the delivery of valve 31 rises as shown by portion C of curve 67.

At this point, solenoid 26, controlled by electronic unit 27, opens electromagnetic valve 23 to supply intake conduit 13 of high-pressure pump 6 with the amount of fuel corresponding to the instantaneous power required of the injection engine, so that high-pressure pump 6 operates at variable capacity, and only brings to high pressure the amount of fuel demanded instantaneously by injectors 22.

The advantages, as compared with known systems, of the valve system according to the invention will be clear from the foregoing description. In particular, it provides for reducing the energy expended to pressurize the surplus fuel, and eliminates the increase in temperature of the fuel in tank 17. Besides controlling intake pressure, overpressure valve 31 also provides for expelling air during startup and for lubricating the mechanical connections. Finally, overpressure valve 31 may be calibrated outside its seat and be seated interchangeably.

Clearly, changes may be made to the regulating system as described herein without, however, departing from the scope of the accompanying claims. For example, the system may be used for controlling the pressure of any other fluid, such as water, oil, etc., and valve body 33 may be shaped externally otherwise than as described, and be seated in any other known manner.

What is claimed is:

1. A valve system for controlling the intake pressure of a fluid in a high-pressure pump, comprising an on-off valve (23) for the fluid entering said pump (6); characterized in that the intake pressure of said pump (6) is controlled by an overpressure valve (31) having an intake side communicating with a delivery side of a low-pressure pump (20) and a delivery side communicating with an intake conduit (68) of said on-off valve (23), said overpressure valve (31) providing for draining any surplus fluid for supply to said pump (6).

2. A valve system as claimed in claim 1, wherein said fluid is a fuel for supply to an injection engine; characterized in that said on-off valve is a variable-capacity electromagnetic valve (23).

3. A valve system as claimed in claim 2, characterized in that said high-pressure pump (6) comprises at least one cylinder (7), a piston (8) sliding in said cylinder (7), and a mechanism (9, 11) for activating said piston (8); said overpressure valve (31) also lubricating said mechanism (9, 11).

4. A valve system as claimed in claim 3, characterized in that said high-pressure pump (6) is a pump with radial cylinders (7), and comprises a body (10) housing said cylinders (7) and said mechanism (9, 11), and a flange (25) for closing said body (10) and carrying an intake conduit (13) for said cylinders (7); said valves (23, 31) being fitted to said flange (25).

5. A valve system as claimed in claim 3, characterized in that said overpressure valve (31) comprises a valve body (33) having a cavity (34), and a cylindrical shutter (37) sliding inside a cylindrical portion (36) of said cavity (34); said shutter (37) being maintained elastically in a closed position, and being moved into an open position by the fuel.

6. A valve system as claimed in claim 5, characterized in that said shutter (37) is pushed by a spring (58) calibrated to ensure supply of the fuel to said electromagnetic valve (23) at a predetermined pressure.

7. A valve system as claimed in claim 6, characterized in that said valve body (33) comprises at least one first orifice (44) for allowing the passage of fuel to lubricate the inside of said high-pressure pump (6); said first orifice (44) being opened by first means (61, 62) carried by said shutter (37).

8. A valve system as claimed in claim 7, characterized in that said valve body (33) comprises at least one second orifice (47) opened by second means (63) carried by said shutter (37) to supply said electromagnetic valve (23) via a corresponding conduit (68) and to drain any surplus fuel via a drain conduit (32).

9. A valve system as claimed in claim 8, characterized in that said shutter (37) also carries third means (64) for venting said overpressure valve (31) before said orifices (44, 47) are opened.

10. A valve system as claimed in claim 7, characterized in that said shutter (37) comprises a lateral wall (51) and an end wall (52); said spring (58) being located outside said shutter (37), between said end wall (52) and a member (66) fitted inside said cavity (34).

11. A valve system as claimed in claim 10, characterized in that said first orifice (44) and said second orifice (47) are formed in a cylindrical wall (35) of said valve body (33) in different axial positions.

12. A valve system as claimed in claim 11, characterized in that said first means (61, 62) comprise an annular chamber (61) formed in said lateral wall (51) of said shutter (37), and at least one calibrated hole (62) at said annular chamber (61); said annular chamber (61) being connected to said first orifice (44) by a predetermined displacement of said shutter (37).

13. A valve system as claimed in claim 12, characterized in that said second means comprise an end edge (63) of said lateral wall (51); said second orifice (47) being so located as to be opened by said end edge (63) by a displacement of said shutter (37) greater than said predetermined displacement.

14. A valve system as claimed in claim 12, characterized in that said third means comprise a calibrated hole (64) formed in said end wall (52).

15. A valve system as claimed in claim 6, characterized in that said spring (58) is calibrated by adjusting the position of said member (66) along a second portion (56) of said cavity (34) with the aid of a gauge for determining the intake pressure of the fuel.

16. A valve system as claimed in claim 15, characterized in that said member (66) is defined by a ball force-fitted inside said second portion (56), or by a threaded pin screwed to a corresponding thread of said second portion (56).

17. A valve system as claimed in claim 6, characterized in that said shutter (37) has a ring (56) projecting with respect to said lateral wall (51); said spring (58) normally keeping said ring (56) resting on a shoulder (55) of said cavity (34).

18. An overpressure valve for controlling the intake pressure of a fuel in an injection engine high-pressure pump (6), comprising a valve body (33) having a cavity (34) in which slides a cylindrical shutter (37); wherein said body is connected to a delivery side of a low-pressure pump (20) and wherein said shutter (37) comprises a lateral wall (51) and an end wall (52); a calibrated spring (58) being located outside side shutter (37), between said end wall (52) and a member (66) fitted inside said cavity (34).

19. An overpressure valve for controlling the intake pressure of a fuel in an injection engine high-pressure pump (6), comprising a valve body (33) having a cavity (34) in which slides a cylindrical shutter (37); wherein said shutter (37) is formed with a lateral wall (51) and an end wall (52), a calibrated spring (58) being located outside said shutter (37), between said end wall (52) and a member (56) fitted inside said cavity (34), and wherein said cavity (34) has a cylindrical wall (35) having at least one first orifice (44) and at least one second orifice (47) in different axial positions; said lateral wall (51) comprising an annular chamber (61) cooperating with said first orifice (44) to supply said high-pressure pump (6), and at least one calibrated hole (62) at said annular chamber (61); said annular chamber (61) being connected to said first orifice (44) by a predetermined displacement of said shutter (37).

20. A valve as claimed in claim 19, characterized in that said lateral wall (51) comprises an end edge (63) cooperating with said second orifice (47) to supply an on-off valve (23) via a corresponding conduit (68) and to drain any surplus fuel via a drain conduit (32); said edge (63) being so located as to open said second orifice (47) by a displacement of said shutter (37) greater than said predetermined displacement.

21. A valve as claimed in claim 20, characterized in that said end wall (52) has a calibrated hole (64) for expelling air before said orifices (44, 47) are opened.

* * * * *